US006941877B2

(12) United States Patent
Dickner

(10) Patent No.: US 6,941,877 B2
(45) Date of Patent: Sep. 13, 2005

(54) LOADING MEMBER

(75) Inventor: Allan Dickner, Älmhult (SE)

(73) Assignee: Inter Ikea Systems B.V., Delft (NL)

( * ) Notice: Subject to any disclaimer, the term of this patent is extended or adjusted under 35 U.S.C. 154(b) by 0 days.

(21) Appl. No.: 10/435,551

(22) Filed: May 12, 2003

(65) Prior Publication Data

US 2004/0025758 A1 Feb. 12, 2004

(51) Int. Cl.[7] ..... B65D 19/00

(52) U.S. Cl. ..... 108/51.11; 108/56.3; 108/53.1; 108/57.12

(58) Field of Search ..... 108/51.11, 57.2, 108/57.14, 57.22, 57.21, 57.23, 53.1, 53.5, 56.3; 248/346.01, 346.02, 346.03, 346.11, 188.9; 206/386, 599

(56) References Cited

U.S. PATENT DOCUMENTS

| | | | | | |
|---|---|---|---|---|---|
| 2,798,600 | A | * | 7/1957 | O'Konski | 206/599 |
| 2,895,608 | A | * | 7/1959 | Wilson | 206/599 |
| 3,097,741 | A | * | 7/1963 | Schwartz | 206/599 |
| 3,699,900 | A | * | 10/1972 | Carlson | 108/53.1 |
| 3,880,286 | A | | 4/1975 | Wegener | |
| 4,065,014 | A | * | 12/1977 | Sagmiller | 414/608 |
| 4,116,344 | A | * | 9/1978 | Ziemba | 248/346.02 |
| 4,148,394 | A | * | 4/1979 | Bederman | 108/56.3 |
| 4,317,517 | A | * | 3/1982 | Tisdale | 206/599 |
| 4,509,433 | A | * | 4/1985 | Farr | 108/52.1 |
| 5,154,297 | A | | 10/1992 | Farley | |
| 5,588,371 | A | * | 12/1996 | Looker | 108/57.12 |
| 5,813,536 | A | | 9/1998 | Bartholomew | |
| 6,722,291 | B2 | * | 4/2004 | Adams et al. | 108/53.1 |

FOREIGN PATENT DOCUMENTS

| | | |
|---|---|---|
| DE | 4342221 A1 | 6/1995 |
| FR | 2335410 A | 7/1977 |
| FR | 2397338 A | 2/1979 |
| GB | 1005589 | 9/1965 |
| GB | 1521077 A | 8/1978 |

* cited by examiner

*Primary Examiner*—Jose V. Chen

(57) ABSTRACT

A loading member with a substantially L-shaped cross section and which jointly with a corresponding loading member may be arranged at the bottom of a box, each member being provided at one of two respective parallel lower edges of the box. The loading members are retained in close abutment with the box by means of circumferential straps or packaging film, whereby the members form feet for the box. A first web of the L-section is provided with at least two pressed hollow projections on the surface intended to face a supporting surface of the loading member. Two of these projections have an interspacing of at least half the length of the member. The width of the projections is less than or equal to half the width of the first web. The projections substantially abut an edge at which the webs of the L-section converge. As a result, a comparatively light loading member is obtained and it is further ensured that the forks of a fork-lift truck can be inserted beneath a loading member when two identical loading members are mounted on two parallel lower edges of the box without causing significant damage to or wear of the loading member.

17 Claims, 3 Drawing Sheets

LOADING MEMBER

TECHNICAL FIELD

The invention relates to a loading member with a substantially L-shaped cross section and which jointly with a corresponding loading member may be arranged at the bottom of a box, each loading member being arranged at one of two parallel lower edges of the box and retained in close abutment therewith by means of circumferential straps or packaging film, whereby the members may form the feet of the box.

BACKGROUND ART

Loading members of the above type are known used when transporting a box, a loading member being arranged jointly with a corresponding member along two parallel lower edges of the box so as to protect the box. The loading members are substantially L-shaped in cross section and retained by means of wrapping material. A plurality of parallel and slightly interspaced ribs are provided on one web of the L-section. The web of the L-section provided with the ribs is substantially completely covered by the ribs. Lifting the box by means of a fork-lift truck is impeded, as it is difficult to insert the forks of the lift truck beneath the box without damaging the loading members and the ribs thereof. This is not quite satisfactory.

BRIEF DESCRIPTION OF THE INVENTION

The object of the invention is to provide a loading member of the above type and of a comparatively simple structure and when two identical loading members are mounted on two parallel lower edges of the box, said members allow forks of a lift truck to be inserted therebeneath (for carrying the box) without causing much damage to or heavy wear of the loading members.

The loading member according to the invention is characterised in that one web of the L-section is provided with at least two pressed hollow projections on the surface intended to face the supporting surface of the loading member, two of the projections having an interspacing of at least half the length of the member and a width being less than or equal to half the width of said web, and further that the projections substantially abut the edge, at which the webs of the L-section converge. As a result the loading member is very light due to the hollow projections as well as very durable. When two identical loading members are mounted on two parallel lower edges of a box and the straps or packaging film have/has been wrapped around the box and the members, the loading members are only subjected to minor wear when the box is moved by means of a fork-lift truck, said wear being limited to the outermost portion of the web provided with the projections. The loading members are furthermore advantageous in that they may be closely stacked when not in use.

According to the invention a small pressed projection may be provided at or adjacent either end of said web and a large pressed projection may be provided between the two small projections, preferably halfway therebetween. The loading members are thus suitable for transporting particularly heavy boxes.

According to the invention the projections may have the shape of a substantially truncated pyramid, whereby an excellent rigidity in the projection walls is obtained.

According to the invention in the longitudinal direction of the said web, the length of the large projection is 1–3.5 times the length of the small projections, whereby a particularly advantageous embodiment is obtained.

Furthermore according to the invention the angle between the webs in the substantially L-shaped cross section may be between 82 and 88°, preferably about 85°. As a result the loading members will be snug against the box when mounted on the said lower edges thereof, and the straps and/or packaging film have/has been wrapped around the box and the loading members.

Moreover according to the invention the walls of each projection may be provided with pressed strengthening ribs around the projection, whereby the position of the straps on each loading member is comparatively easily retained.

According to the invention the width of the second web of the L-section is substantially equal to the width of the first web of the L-section. This embodiment has proved particularly advantageous.

According to the invention the loading member may be made from polypropylene (PP), the outer faces of the projections, however, being coated with a thermoplastic elastomer (TPE), which may have a coefficient of friction $\mu$ of at least 0.5 in relation to a supporting surface (for instance the deck of a lorry). As a result when mounted on the box—the loading member does not so easily cause the box with the loading members to slide on the supporting surface, eg a deck of a lorry.

According to the invention the length of the loading member may be between 750 and 770 mm, preferably 760 mm, and the height of the projections may slightly exceed the thickness of the forks of a fork-lift truck and is preferably about 35–40 mm. It is thus possible to insert most lift truck forks beneath the loading member.

Furthermore according to the invention the length of the small projections may be less than or equal to half of their width. This embodiment turned out to be particularly advantageous.

Finally according to the invention the width of the large projection may be less than the width of the small projections and the length of the large projection is larger than the width of the large projection, preferably 1.7–2.0 times said width. This embodiment has proved to be particularly advantageous.

BRIEF DESCRIPTION OF THE DRAWINGS

The invention is explained in greater detail below with reference to the accompanying drawings, in which.

BEST MODES FOR CARRYING OUT THE INVENTION

Figure 1:
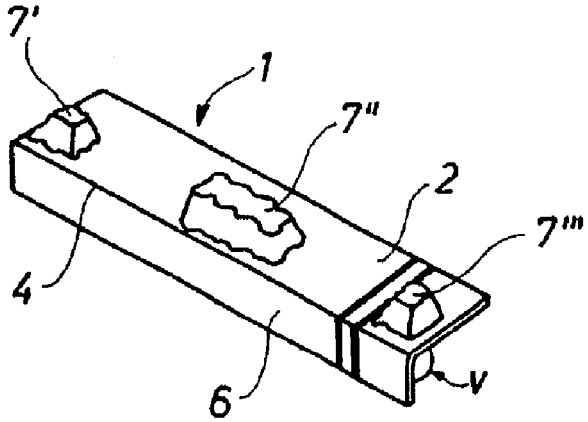
FIG. 1 is an inclined bottom and perspective view of a embodiment of the loading member according to the invention.

The loading member 1 with a substantially L-shaped cross section shown in FIG. 1 may be arranged jointly with a corresponding loading member at the bottom of a box 3 (confer FIG. 4), each member being provided at one of two parallel edges 3*a* and 3*b*, respectively, of the box. By means of circumferential straps 5 or packaging film the loading members are retained in close abutment with the box. At the web 2 intended to face the supporting surface (eg a deck of a lorry) the loading member 1 is provided with at least two pressed hollow projections 7', 7" 7'". Two of the projections, viz. the projections 7' and 7'", have an interspacing a (confer FIG. 3) being at least half the length 1 of the loading member 1 (confer FIG. 2). In FIG. 1 the actual interspacing a is about 0.80×1. The width b of each projection 7', 7", 7'" is less than or equal to half the width b2 of the web 2. The projections 7', 7", 7'" abut the edge 4 at which the webs 2 and 6 of the loading member converge.

As shown in FIG. 1, the pressed projections 7' and 7'" may be comparatively small and arranged adjacent at opposite ends of the web 2 of the loading member. The projection 7", which is a comparatively large projection, is arranged between the two small projections. Preferably the large projection is arranged as shown halfway between the two small projections 7' and 7".

Figure 5:
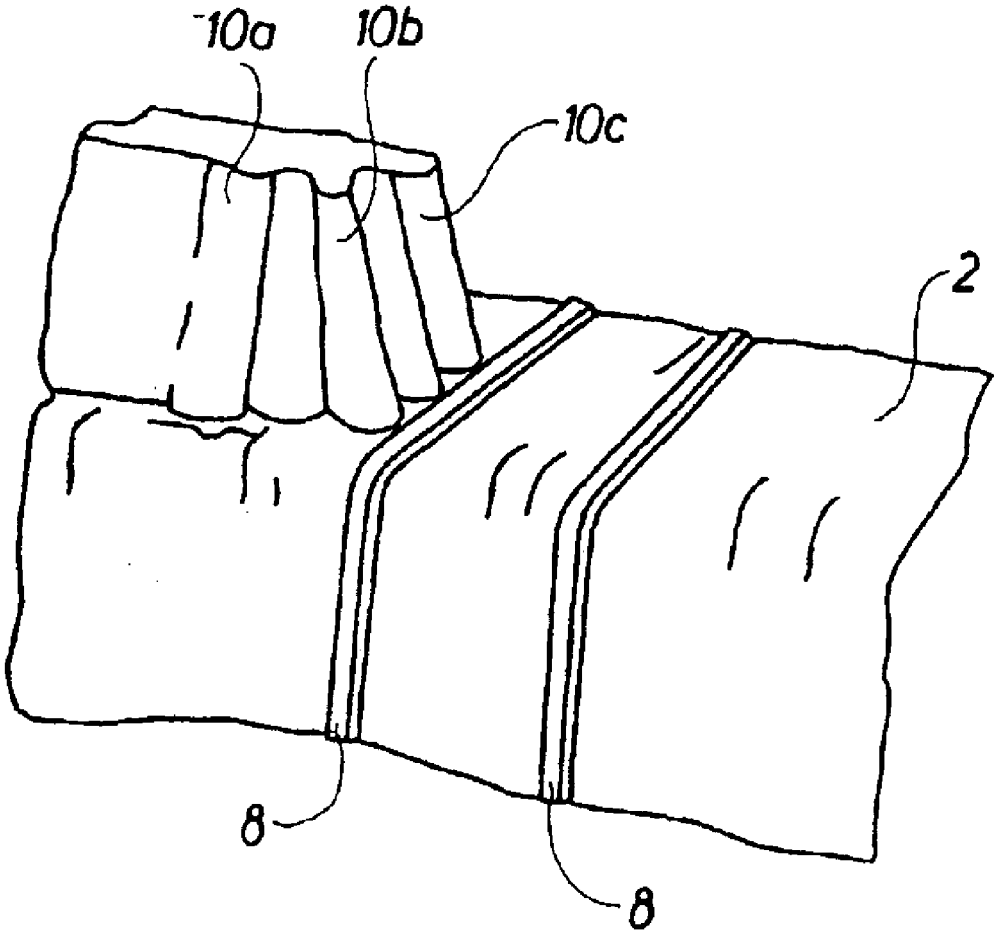
FIG. 5 is a perspective view of a portion of a loading member in which the shape of a portion of a projection is clearly visible.

As particularly apparent of FIG. 5, each projection may have the shape of a substantially truncated pyramid. On its lateral faces the truncated pyramid may be provided with pressed strengthening ribs 10*a*, 10*b*, 10*c* (not all strengthening ribs are provided with reference numerals). These ribs may either extend from the projection or into the projection.

The large projection 7" may have a length x" (confer FIG. 3) corresponding to 1–3.5 times the length x of the small projections 7', 7'". The angle v between the webs 2 and 6 may be between 82 and 88°, preferably of about 85° in the substantially L-shaped cross section of the member 1.

Figure 6:
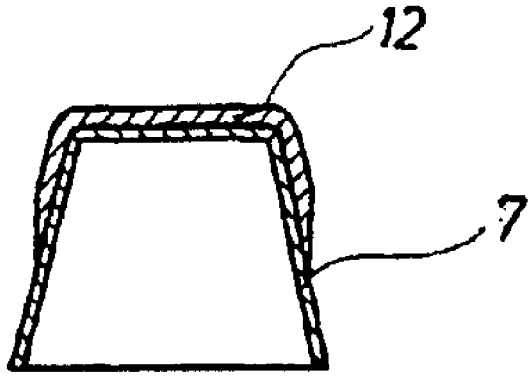
FIG. 6 is a cross-sectional view of a portion of a projection, in which it is particularly visible how the projection may be coated with a thermoplastic elastomer layer.

As shown in FIG. 6, guide grooves or protrusions 8 may be provided at least in the webs 2 and 6 of the L-section on the face thereof intended to face away from the box, said guide grooves or protrusions enabling positioning of wrapping tapes 5 for the loading members and the box 3 or stabilisation of a plastic film packaging wrapped around the members and the box. The latter option is, however, not shown. Either a stretch film or a shrink film may be used.

As shown in FIG. 1 the second web 6 of the L-section may have a width b6 being substantially half the width b2 of the first web 2 of the L-section.

The loading member may be made of polypropylene (PP). It is furthermore possible to provide outer faces of the projections 7', 7", 7'" with a layer 12 of a thermoplastic elastomer (TPE) to increase the friction between the loading member and a supporting surface (eg a deck of a lorry). Preferably, the elastomer used has a coefficient of friction $\mu$ of at least 0.5 in relation to the said supporting surface.

The length of the loading member may be between 750 and 770 mm, preferably 760 mm. The height h (FIG. 2) of the projections 7', 7", 7'" may slightly exceed the thickness of the forks of a fork-lift truck; Usually the height is about 35–40 mm.

Figure 3:
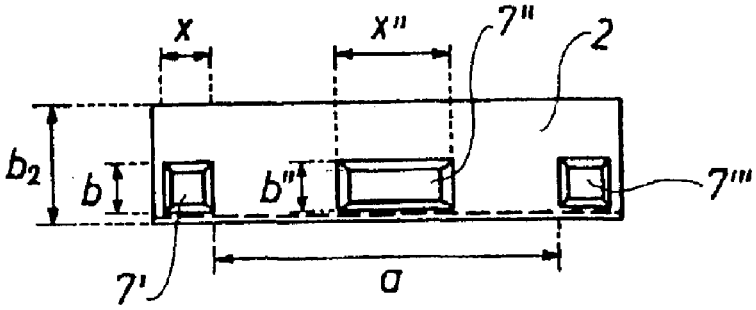
FIG. 3 is a rear view of the same embodiment.
Figure 4:
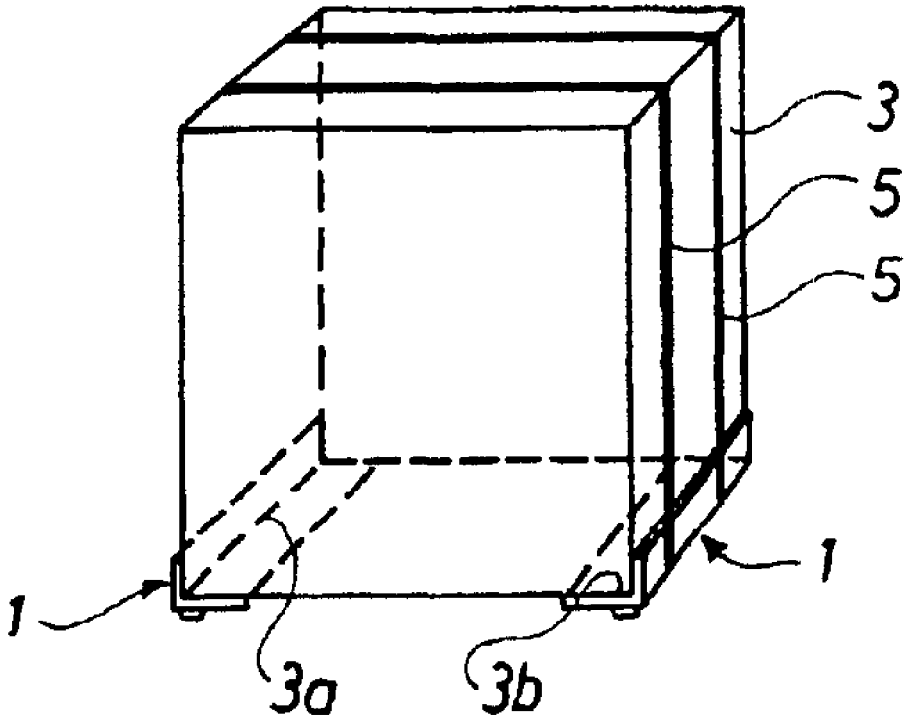
FIG. 4 illustrates a box on which two loading members according to the invention have been mounted.

As shown in FIG. 3, the length x of the small projections 7' and 7'" may be less than or equal to half their width b.

Figure 2:
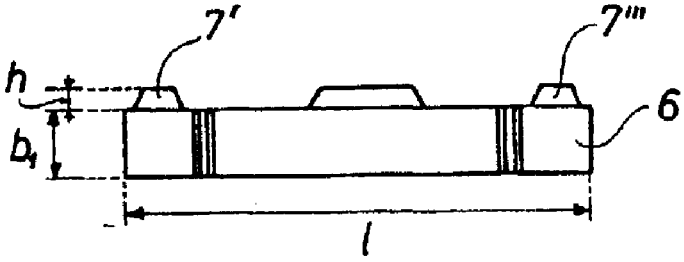
FIG. 2 is a side view of the same embodiment.

The large projection 7" shown in FIGS. 1–3 may have a width b" slightly less than the width b of the small projections 7' and 7".

The invention may be modified in many ways without thereby deviating from the scope of the invention, as it appears from the attached claims.

What is claimed is:

1. A loading member, comprising:

a substantially L-shaped cross section which jointly with a corresponding loading member can be arranged at the bottom of a box, each member being provided at one of two respective parallel lower edges of the box and retained in close abutment with the box by means of circumferential straps or packaging film, whereby the members form feet for the box;

a plurality of webs in the L-section, a first web of the L-section is provided with at least two pressed hollow projections on a surface intended to face a supporting surface of the loading member, two of these projections having an interspacing of at least half a length of the member, and the projections substantially abut an edge at which the webs of the L-section converge.

2. The loading member according to claim 1, wherein a small pressed projection is provided at or adjacent to both ends of said first web, and a large pressed projection is provided between the two small projections.

3. The loading member according to claim 2, wherein the large projection is provided approximately halfway between the small projections.

4. The loading member according to claim 2, wherein the length of the large projection is 1–3.5 times the length of the small projections.

5. The loading member according to claim 2, wherein the length of the small projections is less than or equal to their width.

6. The loading member according to claim 5, wherein the width of the large projection is less than half the width of the small projections.

7. The loading member according to claim 1, wherein the projections have a shape of a substantially truncated pyramid.

8. The loading member according to claim 1, wherein an angle between the webs in the substantially L-shaped cross section is between 82° and 88°.

9. The loading member according to claim 8, wherein the angle between the webs in the substantially L-shaped cross section is approximately 85°.

10. The loading member according to claim 1, wherein walls of each projection are provided with pressed strengthening ribs around the projection.

11. The loading member according to claim 1, wherein guide grooves are provided at least in a second web of the L-shaped cross section on a face thereof facing away from the box, said grooves being intended for positioning the straps wrapped around the members and the box or for stabilizing the plastic film packaging wrapped around the members and the box.

12. The loading member according to claim 11, wherein a width of the second web of the L-shaped cross section is substantially half a width of the first web of the L-shaped cross section.

13. The loading member according to claim 1, wherein the loading member is made from polypropylene, the outer faces of the projections being coated with a thermoplastic elastomer having a coefficient of friction of at least 0.5 in relation to a supporting surface.

14. The loading member according to claim 1, wherein the loading member has a length between 750 and 770 mm, and a height of the projections slightly exceeds the thickness of the forks of a fork-lift trunk.

15. The loading member according to claim 14, wherein the length is approximately 760 mm.

16. The loading member according to claim 14, wherein the thickness is approximately 35–40 mm.

17. The loading member according to claim 1, wherein a width of the projections is less than or equal to half a width of the loading member.

* * * * *